US005215477A

United States Patent [19]

Weber et al.

[11] Patent Number: 5,215,477

[45] Date of Patent: Jun. 1, 1993

[54] VARIABLE LOCATION CONNECTOR FOR COMMUNICATING HIGH FREQUENCY ELECTRICAL SIGNALS

[75] Inventors: William F. Weber, Allen; Leon Jinich, Plano, both of Tex.

[73] Assignee: Alcatel Network Systems, Inc., Richardson, Tex.

[21] Appl. No.: 885,418

[22] Filed: May 19, 1992

[51] Int. Cl.[5] ..... H01R 13/00

[52] U.S. Cl. ..... 439/581

[58] Field of Search ..... 439/578-585

[56] References Cited

U.S. PATENT DOCUMENTS 4,995,815 2/1991 Buchanan et al. ..... 439/581

*Primary Examiner*—Joseph H. McGlynn

*Attorney, Agent, or Firm*—Bruce C. Lutz; Dennis O. Kraft

[57] ABSTRACT

A connector for connecting coaxial cable to a microstrip transmission line on a substrate is disclosed. The connector includes tapped threaded holes in a mounting plate, and an extended throat between the mounting plate and the threaded coaxial coupler. The threaded holes and extended throat allow for the mounting of the connector on the inner surface of the chassis wall, for example within a machined cavity or within a stamped dimple. The chassis bolt holes are oversized, to allow for fine adjustment of the vertical and lateral position of the connector on the chassis wall relative to the transmission line trace. The resulting connection has reduced UHF signal attenuation, and also a higher reliability connection to the transmission line.

16 Claims, 3 Drawing Sheets

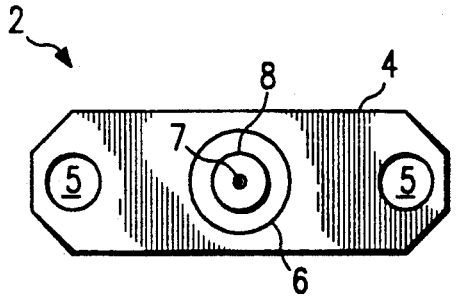
FIG. 1a
(PRIOR ART)
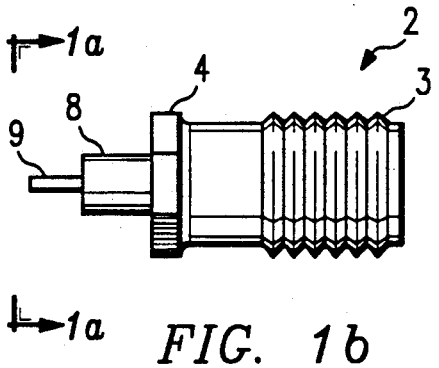
FIG. 1b
(PRIOR ART)
FIG. 2
(PRIOR ART)
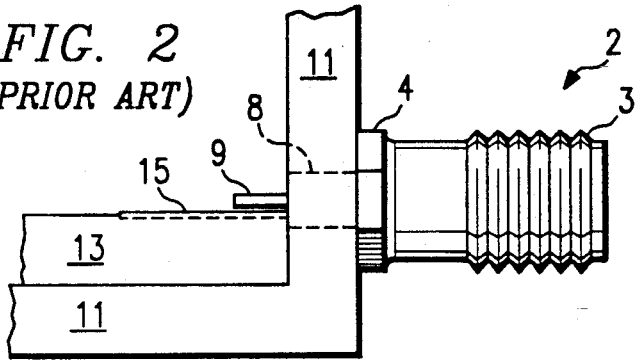
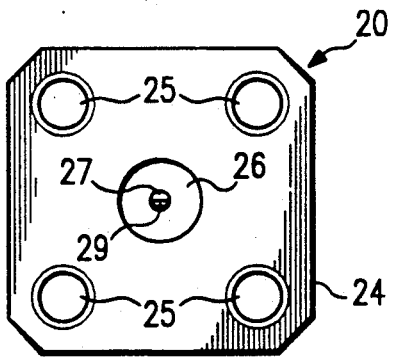
FIG. 3b
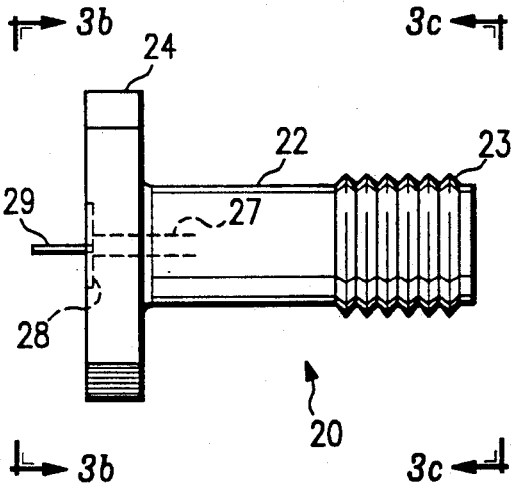
FIG. 3a
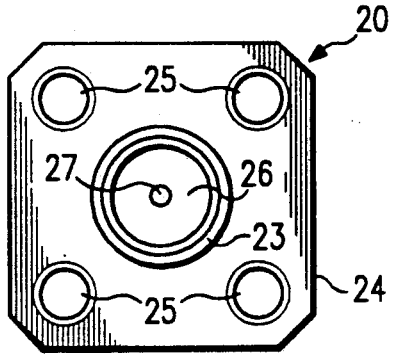
FIG. 3c

VARIABLE LOCATION CONNECTOR FOR COMMUNICATING HIGH FREQUENCY ELECTRICAL SIGNALS

This invention is in the field of electrical connectors, and is more particularly directed to connectors for communicating high frequency signals.

BACKGROUND OF THE INVENTION

In the field of ultra high frequency (UHF) electronics, particularly for systems operating at frequencies above 1 GHz or higher, significant signal attenuation and power loss has been attributable to mechanical connectors between system components. A particularly troublesome connection in the field of UHF electronics is that between transmission lines of different types, for example the connection between microstrip transmission lines and coaxial cable.

Referring to FIGS. 1*a* and 1*b*, a conventional connector 2 for connecting coaxial cable to a trace on a substrate or circuit board, where the trace is a conductor in a microstrip transmission line, is illustrated in front and side elevation views. Mounting plate 4 of connector 2 has non-tapped holes 5 through which machine screws may pass to mount connector 2, as will be described hereinbelow. Connector 2 also has threaded end 3 for threadably connecting to conventional coaxial cable, for example of the 50Ω type.

Contained within connector 2 is an interior wire 7 (see FIG. 1*a*) which connects on one side to the interior conductor of the coaxial cable, and which terminates, on the other side, as lead tab 9. Surrounding wire 7 within connector 2 are inner insulator portion 6 and extending insulator portion 8. The material of insulator portions 6, 8 is TFE fluorocarbon or other conventional material. Inner insulator portion 6 has a circular cross-section, and terminates at the face of plate 4. Extending insulator portion 8 extends away from plate 4, and has a smaller cross-section than that of insulator portion 6 within plate 4. The length of extending insulator portion 8 corresponds approximately to the thickness of the chassis or wall to which connector 2 is mounted. Lead tab 9 extends from extending insulator portion 8 and is suitable to be soldered to a conventional microstrip transmission line on a patterned substrate. Lead tab 9 either may have a circular cross-section, or alternatively may be a flat tab.

It has been observed that conventional connectors, such as connector 2 of FIGS. 1*a* and 1*b*, significantly attenuate UHF electrical signals, particularly as the signal frequency increases above 1 GHz. This attenuation is believed to be due to physical impedance discontinuities resulting from the construction of the connector and the quality of the connection. One such discontinuity is that presented by the reduction in diameter from insulator portion 6 within plate 4 to the smaller diameter of extending portion 8. This step-down in the diameter of the insulating material can attenuate UHF signals, as it presents a discontinuity of the 50Ω impedance in the system between the microstrip transmission line to which lead 9 connects and the coaxial cable to which threaded end 3 connects. Furthermore, the diameter of the center pin (e.g., wire 7) in conventional connectors steps down in diameter at the same location at which the diameter of the insulating material steps down in diameter, exacerbating the impedance discontinuity. Other discontinuities presented by connector 2 will now be described relative to FIG. 2, which illustrates, in cross-section, the mounting of conventional connector 2 to a conventional chassis.

In FIG. 2, connector 2 is illustrated as mounted to chassis 11 by way of machine screws (not shown) that pass through mounting holes 5 in plate 4 and that thread into tapped holes (not shown) in chassis 11. As a result, plate 4 of connector 2 is located outside of the wall of chassis 11. Extending portion 8 extends through a matching hole in the wall of chassis 11, so that lead tab 9 extends therefrom as shown. Chassis 11 includes a floor portion upon which substrate 13 is placed in the assembly process. Substrate 13 includes microstrip transmission lines thereon, including trace 15 to which connection is to be made by connector 2 in this example. In the best case, lead tab 9 extends from chassis 11 at a height that is slightly above (e.g., 0.002 inches) trace 15 on substrate 13, to allow for subsequent soldering to make a good connection therebetween.

The installation of connector 2 is conventionally performed after substrate 13 is in place within chassis 11. Lead tab 9 and extending insulator portion 8 of connector 2 are inserted into the hole in the wall of chassis 11, and screwed into place by machine screws passing through holes 5 of connector 2 and threading into threaded holes in the wall of chassis 11. After connector 2 is tightened into place, soldering of lead tab 9 to its mating trace 15 is performed in the conventional manner.

Significant problems have been observed that adversely affect the quality and reliability of the connection between lead tab 9 and trace 15, and that contribute to the attenuation of UHF electrical signals communicated through connector 2, according to this conventional construction and method of installation, however. These mechanical problems primarily arise from the tolerances to which the substrate 13 and chassis 11 can be constructed, as will be apparent from the following example.

The relationship between substrate 13 thickness and the position of connector 2 can be considered as follows:

$$t_{13}+GAP=h_9-0.5(t_9)$$

where $t_{13}$ is the thickness of substrate 13, $h_9$ is the height of the center of lead tab 9 above the floor of chassis 11, and $t_9$ is the thickness of lead tab 9, with GAP being the gap between the bottom of lead tab 9 and the top of trace 15. By way of example, a typical substrate 13 is manufactured to a thickness specification (including the thickness of trace 15) of 0.202±0.011 inches. In order to make connection to such a substrate, in this example the specification of the position of the center of the hole through the wall of chassis 11 is 0.209±0.003 inches above the floor of chassis 11. Considering lead tab 9 with a thickness of 0.010 inches, the nominal value of GAP will be 0.002 inches in this example, suitable for a high reliability solder connection.

However, the tolerances specified above for substrate 13 thickness and connector 2 position can result in undesirable GAP values, and significant mechanical problems. For example, where substrate 13 is manufactured to its minimum thickness within the specification range, and where the hole in the wall of chassis 11 is at its highest position, the value of GAP in this example will be +0.016 inches. This large gap between lead tab 9 and trace 15 may result in an imperfect solder connection therebetween, or in electrical transmission discontinuity. Especially at UHF frequencies, such a poor connection will significantly attenuate the power of the signals transmitted between the microstrip transmission line and the coaxial cable. In addition, thermal cycling of such a poor solder connection can produce a later life open connection, resulting in system failure after installation and costly corrective action.

The other extreme condition in this example is for substrate 13 manufactured to its maximum specification thickness in combination with the position of connector 2 at its lowest position. In this condition, the value of GAP will be −0.012 inches (i.e., the lower edge of lead tab 9 is below the top of trace 15 by this amount), resulting in a "crash" fit connection as connector 2 is inserted through the wall of chassis 11 with substrate 13 in place. This crash fit can result in lifting of trace 15 by lead tab 9 when it is installed, if lead tab 9 is inserted in such a manner as to peel trace 15 from substrate 13. Lead tab 9 may also bend or break when inserted in such a crash fit connection, resulting in poor solder connection, UHF signal attenuation and, in the worst case, an open connection.

Another consideration in this conventional connection scheme is the thickness tolerance to which the wall of chassis 11 can be machined, relative to the length of extending insulator portion 8. If the wall of chassis 11 is too thin, insulator extending portion 8 will protrude into the interior of chassis 11, pushing against substrate 13 when inserted and possibly preventing connection therebetween. If the wall of chassis 11 is too thick, air will surround lead tab 9 within chassis 11, presenting an impedance discontinuity that will tend to attenuate UHF signals communicated through connector 2. Furthermore, the tolerance of the angle at which the floor of chassis 11 is machined relative to the wall (nominally perpendicular) can also affect the fit of lead tab 9 to trace 15, and present problems similar to those noted hereinabove.

Still another problematic dimensional tolerance is that of the tolerance of the diameter of the hole in the wall of chassis 11 into which extending insulator portion is placed. If the hole is too small, connector 2 cannot be inserted thereinto. If the hole is too large, wire 7 and lead tab 9 will not be symmetrically located within the cross-section of the hole, which can also affect the impedance of the connection, and attenuate UHF signals communicated through connector 2.

The problems caused by the relative tolerances of the substrate and chassis have been previously addressed by tightening the manufacturing specifications of the various components, which of course greatly increases system manufacturing cost of the system due to lower manufacturing yield to the more stringent specifications. Even with tighter dimensional tolerances, however, the problems of excessive gaps, crash fits and impedance discontinuities discussed above have still been observed to a significant extent.

While the above-described problems are present for a single connector into a chassis, virtually every system requires multiple connectors for each chassis, located on more than one wall, each connecting to the same substrate. The provision of multiple connectors on multiple sides of the chassis not only increases the likelihood of a bad connection, but also brings into play other dimensional tolerances such as the angles of the chassis wall to one another, the flatness of the substrate to which connection is made, and the like.

These problems arising from the manufacturing tolerances of the chassis and substrates occur even for chassis formed by precision machining. As a result, the use of less precise, and less costly, manufacturing processes for the chassis (e.g., the use of sheet metal chassis) has been precluded for UHF systems.

It is therefore an object of the present invention to provide a connector which can be connected to a transmission line trace in an adjustable manner.

It is a further object of the present invention to provide such a connector which allows the chassis and substrate to be manufactured to relatively loose tolerances, and thus with low manufacturing costs.

It is a further object of the present invention to provide such a connector which enables the use of low cost chassis materials, such as sheet metal, while still maintaining high quality and high reliability connections.

It is a further object of the present invention to provide such a connector which reduces impedance discontinuities in making a coaxial-to-microstrip connection through a chassis wall.

It is a further object of the present invention to provide such a connector which provides flexibility of mounting both vertically and horizontally, thus accounting for variations in substrate thickness and chassis hole placement, as well as for variations in the location of traces on the substrate.

It is a further object of the present invention to provide an ultra high frequency chassis incorporating such a connector system.

Other objects and advantages will be apparent to those of ordinary skill in the art having reference to the following specification together with the drawings.

SUMMARY OF THE INVENTION

The invention may be incorporated into a microstrip-to-coaxial connector having tapped threaded mounting holes for threadably receiving machine screws, and having an extended throat for its threaded coaxial end. This construction of the connector according to the present invention allows for its mounting to the inner surface of the chassis wall, as the extended throat accounts for the thickness of the chassis wall. Oversized non-threaded holes are provided in the chassis wall to allow the vertical and lateral position of the connector to be adjusted during installation, ensuring a high quality and high reliability solder connection to microstrip transmission lines in each installation, even for chassis and substrate construction having relatively wide dimensional tolerances. The flexibility provided by the present invention allows for the use of less precise chassis construction, including the use of low cost stamped sheet metal as the chassis material.

BRIEF DESCRIPTION OF THE DRAWINGS

FIGS. 1*a* and 1*b* are side and front elevation views of a connector according to the prior art.

FIG. 2 is a cross-sectional view of a chassis and substrate system into which a connector is implemented according to the prior art.

FIGS. 3*a* through 3*c* are elevation views of a connector according to the preferred embodiment of the invention.

DETAILED DESCRIPTION OF THE PREFERRED EMBODIMENTS

Figure 6:
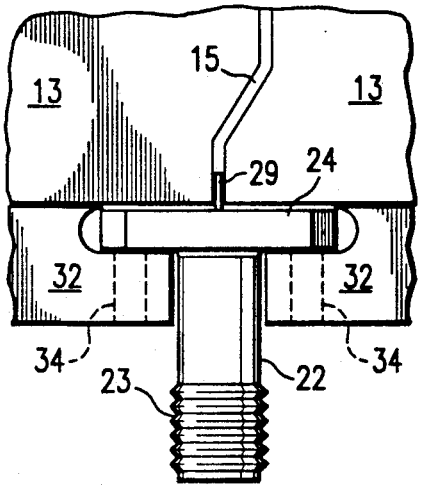
FIG. 6 is a plan view of the connector according to the preferred embodiment of the invention as implemented into a machined chassis, illustrating the connection to a microstrip transmission line trace.

Referring first to FIGS. 3*a*, 3*b* and 3*c*, connector 20 according to the preferred embodiment of the invention will now be described in detail. This example of connector 20 is for making connection between a microstrip transmission line and a coaxial cable, such as of the 50Ω type. As such, referring to the side view of connector 20 shown in FIG. 3*a*, lead tab 29 extends from one side of plate 24 in connector 20, and threaded end 23 extends from the opposing side of plate 24 therefrom. In this example, threaded end 23 is a conventional female SMA connector (i.e., according to the specification MIL-C-39012, series SMA); of course, threaded end 23 may alternatively be a male SMA connector or such other conventional connecting end as desired for the particular application of connector 20.

According to the present invention, plate 24 is constructed of conventional material, such as non-magnetic stainless steel (e.g., according to the specification ASTM-A-582, class 303, condition A). Plate 24 has four tapped threaded holes 25 (see FIGS. 3*b* and 3*c*) at each of its four corners, into which conventional machine screws may thread to mount connector 20 to a chassis in the manner described hereinbelow. In this embodiment of the invention, tapped threaded holes 25 allow plate 24 to be mounted to an inner surface of a chassis wall, rather than on the outer surface thereof as described hereinabove for conventional connectors such as connector 2 of FIGS. 1*a*, 1*b* and 2. Accordingly, connector 20 includes an elongated throat 22 to extend threaded end 23 from plate 24 by a sufficient distance to account for the thickness of the chassis wall to which connector 20 is to be mounted. An example of the length of throat 22 between plate 24 and the inner edge of threaded end 23 is on the order of 0.25 to 0.50 inches; this length may vary, of course, depending upon the thickness of the chassis wall to which connector is to be mounted.

As connector 20 is intended for connection to coaxial cable by way of threaded end 23, connector 20 includes insulating material 26 therewithin that surrounds conducting pin 27 as shown in FIGS. 3*b* and 3*c*. Insulating material 26 is of conventional type for coaxial connectors, such as TFE fluorocarbon material according to the specifications of ASTM-D-1710, type 1, grade 1. Pin 27 is of conventional thickness for connection to 50Ω coaxial cable, for example 0.319 inches in diameter. As shown in FIG. 3*b*, viewing connector 20 from the side from which lead tab 29 extends, lead tab 29 is significantly smaller than pin 27 and is offset below the center line of pin 27. As is known in the art, lead tab 29 preferably has a rectangular cross-section to confine electric field radiation at the point of its connection to trace 15. An example of the rectangular cross-section for lead tab 29 is approximately 0.0177 by 0.0098 inches.

Figure 9A:
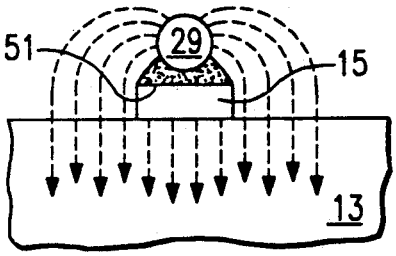
FIGS. 9*a* and 9*b* are schematic diagrams illustrating the electric field between a transmission line trace and lead tabs of circular and rectangular cross-section, respectively.
Figure 9B:
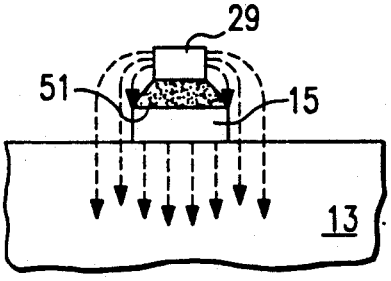

Referring to FIGS. 9*a* and 9*b*, the electric field lines in the connection to transmission line trace 15 are qualitatively shown for wire 29' of circular cross-section and lead tab 29 of rectangular cross-section, respectively. In each of the examples shown in FIGS. 9*a* and 9*b*, solder filaments 51 attach wire 29' and lead tab 29, respectively, to trace 15. As shown in FIG. 9*a*, the circular cross-section of wire 29' causes significant electric field radiation away from trace 15, which contributes to the attenuation of high frequency signals communicated from trace 15 to wire 29'. In contrast, as shown in FIG. 9*b*, the rectangular cross-section of lead tab 29 serves to confine the electric field radiation to within a much smaller distance from trace 15, minimizing the attenuation of high frequency signals at the point of connection.

Referring back to FIGS. 3*a* through 3*c*, the surface of insulator 26 in connector 20 is slightly recessed from the surface of plate 24 from which lead tab 29 extends, as shown by edge 28 in FIG. 3*a*. Such recessing of insulator 26 according to this embodiment of the invention accounts for the thermal expansion of insulator 26 relative to connector 20, and prevents insulator 26 from expanding out of the plane of the inner surface of plate 24 and exerting mechanical force against the substrate to which lead tab 29 connects. The depth of recess 28 may be quite small, for example on the order of 0.005 inches from the surface of plate 24, but may of course vary depending upon the coefficient of thermal expansion of insulator 26.

Figure 4:
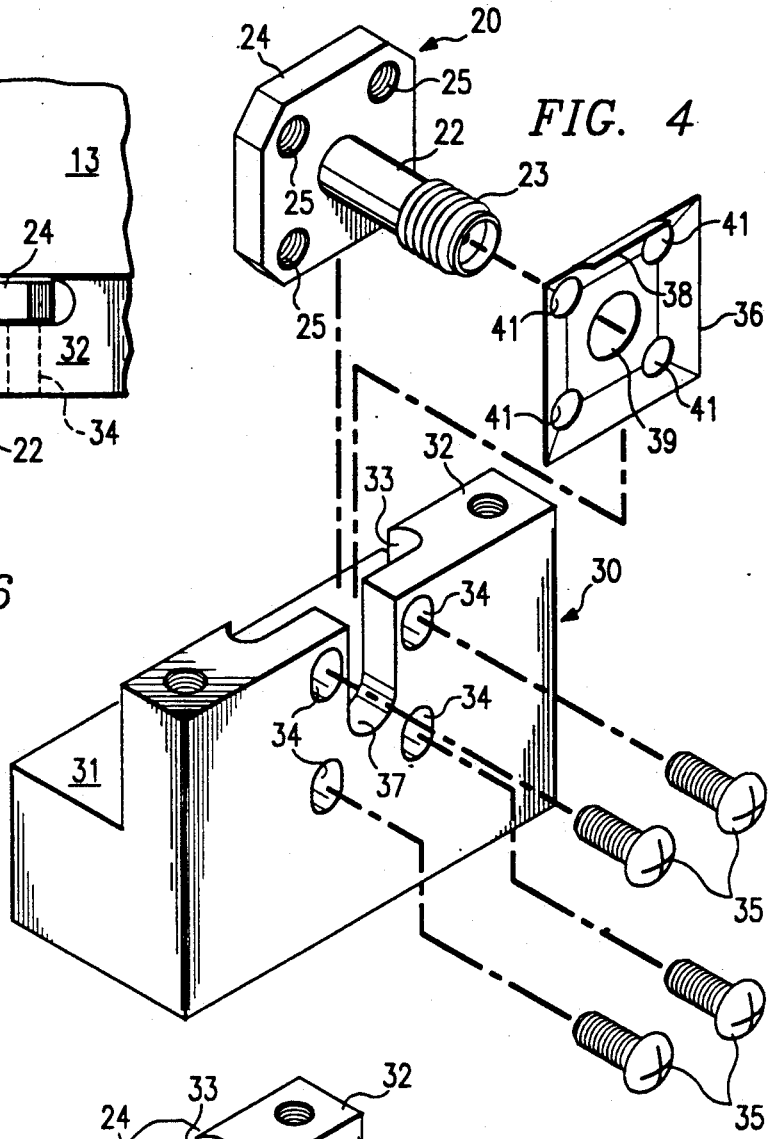
FIG. 4 is an exploded view of the connector according to the preferred embodiment of the invention as implemented into a machined chassis.
Figure 5:
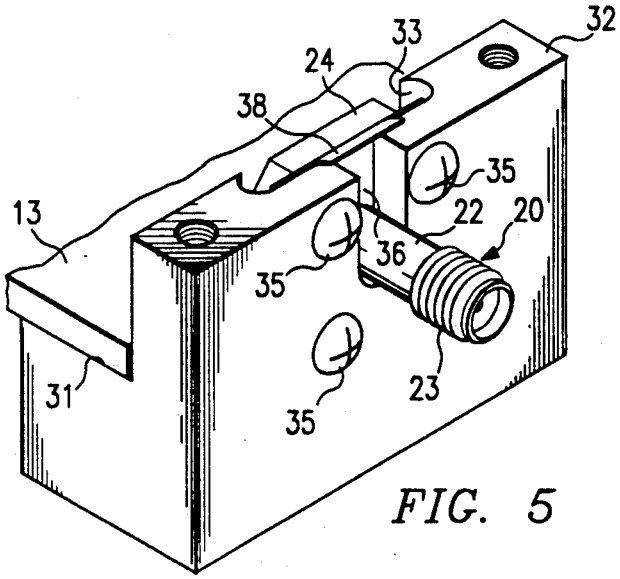
FIG. 5 is a perspective view of the connector according to the preferred embodiment of the invention as installed into the machined chassis of FIG. 4.

Referring now to FIGS. 4 and 5, the implementation of connector 20 into machined chassis 30 according to a first embodiment of the invention will now be described in detail. Machined chassis 30 is formed from conventional material, such as aluminum, by way of conventional precision machining, resulting in a floor 31 and walls 32 (only one of which is shown in FIGS. 4 and 5). In this embodiment of the invention, cavity 33 is machined into wall 32 of chassis 30 to receive plate 24 of connector 20. In addition to the portion of cavity 33 that receives plate 24, slot 37 is provided through which throat 22 and threaded end 23 of connector 20 may extend.

Oversize holes 34 are drilled through wall 32 to allow machine screws 35 to pass therethrough and thread into tapped threaded holes 25 of plate 24 in connector 20. The size of holes 34 are preferably larger than necessary to receive screws 35 to allow for fine adjustment of the position of connector 20 when placed in cavity 33. In this example, oversize holes 34 are of an oval shape, larger in the vertical direction than in the lateral direction, to allow for a greater degree of freedom for the vertical positioning of connector 20 relative to the lateral positioning thereof (but still providing some lateral movement of connector 20).

Gasket 36 is also provided in this embodiment of the invention, for placement between the outer side of plate 24 and the inner edge of cavity 33 when connector 20 is installed in chassis 20. Gasket 36 is preferably of conductive material, such as a 0.004 inch thick Be/Cu sheet, to provide electromagnetic interference (EMI) shielding, particularly at radio frequencies and above. Gasket 36 is particularly useful in this embodiment of the invention, as oversized holes 34 and slot 37 would otherwise allow leakage of EMI from connector 20. Gasket 36 preferably includes an overhanging lip 38 to cover the top of cavity 33, further improving the EMI shielding. Center hole 39 in gasket 36 mates with threaded end 23 and throat 22 of connector 20, and corner holes 41 of gasket 36 mate with tapped threaded holes 25 of connector 20.

According to this embodiment of the invention, the substrate (not shown) to which connection is to be made is first placed within chassis 30, resting upon floor 31 and abutting wall 32, with the position of slot 37 and cavity 33 in substantial alignment with a microstrip transmission line trace to which connection is desired. After the substrate is in place within chassis 30, gasket 36 is placed over connector 20, with throat 22 extending through center hole 39 of gasket 36, and with gasket corner holes 41 mating with connector corner holes 25. The combination of gasket 36 and connector 20 is then slid into cavity 33 from the top of chassis 30 until lead tab 9 is in contact with the substrate. Machine screws 35 are then screwed, but not tightened, into tapped threaded holes 25, passing through holes 34 in chassis 30 and gasket corner holes 41.

After screws 35 have been loosely screwed into connector 20, fine adjustment in the position of connector 20 relative to the substrate may be made. In particular, the vertical position of lead tab 29 over the corresponding trace may be closely adjusted, preferably so that the bottom of lead tab 29 is slightly (e.g., 0.002 inches) above the top surface of the trace to allow for solder flow therebetween. After such positioning, screws 35 are fully tightened to maintain connector 20 in the desired position. Since in most cases multiple connectors 20 will be installed for a single chassis 30, each connector 20 is individually positioned and tightened over its associated trace. FIG. 5 illustrates the completed installation of connector 20 in chassis 30, including gasket 36 with lip 38 extending over slot 37. After the tightening of machine screws 35, lead tab 29 is soldered in the conventional manner to its corresponding trace on the substrate.

FIG. 6 shows connector 20 over trace 15 on substrate 13 according to the present invention, in plan view. In addition to the vertical positioning of lead tab 29 over trace 15, as noted above, the present invention also allows for some freedom of movement laterally, so that lead tab 29 may be centered over trace 15 as shown in FIG. 6. Such centering of lead tab 29 is highly preferred to ensure that the connection is of the highest reliability, and so that attenuation of UHF signals passing therethrough does not result from off-centered connection between lead tab 29 and trace 15.

As a result of the present invention, connection between coaxial cable and a microstrip transmission line may be made with high reliability and quality, and with minimal risk of damage to lead tab 29 or the microstrip transmission line. These improvements result from the ability to install connector 20 into chassis 30 in a manner that allows its position to be finely adjusted relative to the transmission line. This ability is provided by the location of tapped threaded holes 25 in plate 24 of connector 20, rather than in chassis 30, together with extended throat 22 allowing for the wall of chassis 30 to be located between plate 24 and screws 35, as holes 34 in chassis wall 32 may now be oversized to allow positional adjustment. The vertical spacing between lead tab 29 and trace 15 can thus finely adjusted for each connector at installation, in a manner less vulnerable to variations in the thickness of substrate 13 and the position of holes 34 in chassis 30. Installation of connector 20 from above substrate 13 is also enabled by this construction of connector 20, so that a crash fit of lead tab 29 from the side of chassis 30 is never required; this eliminates loss due to lifted traces, and broken or bent lead tabs. Oversizing of holes 34 in the lateral direction also allows for precise centering of lead tab 29 over its corresponding trace 15.

The adjustable positioning of connector 20 according to the present invention not only enables high reliability and high quality connections, but also enables significant reduction in the manufacturing cost of the system by allowing wider tolerance and lower cost construction of the components. This is because the finely adjustable placement of connector 20 reduces the criticality of thickness of substrate 13, enabling substrate 13 to be produced in a less precise manner, and reducing waste due to non-conformance with tight tolerance substrate thickness specifications. Secondly, chassis 30 may also be produced with less critical dimensional control, and thus with lower cost techniques and reduced waste, as the position of the holes 34 through the chassis wall is much less critical according to the present invention. Furthermore, the absolute angle of floor 31 of chassis 30 relative to the horizontal is also less critical, as substrate 13 may sit therewithin at a small angle from the horizontal so long as floor 31 is perpendicular to wall 32 (as is inherently the case in conventional machining), while still maintaining high quality connection between lead tab 29 and trace 15.

Connector 20, having extended throat 22 so that plate 24 is on the inside of chassis wall 32 when installed, also provides improved UHF electrical performance over prior connectors. Since plate 24 is on the inner surface of wall 32, insulator 26 need not extend through wall 32 as in prior connectors, and therefore may be of a single diameter, avoiding the impedance discontinuity present in conventional connectors mounted on the outside of the chassis wall. Absence of this discontinuity eliminates one source of impedance disruption, and thus a source of UHF attenuation in the connector according to the present invention. In addition, the ability to mount plate 24 on the inside of chassis wall 32 according to the present invention also eliminates impedance discontinuities due to manufacturing variation in chassis wall thickness and connector hole diameter, as is the case for conventional connectors as described hereinabove. The attenuation of UHF signals due to asymmetric positioning of the conductor in a hole through the chassis wall or variations in the chassis wall thickness is also eliminated by the present invention.

Mechanical stresses int eh finished unit are also greatly reduced, especially those resulting from force applied by connector insulator against the substrate when the chassis wall is thinner than optimal. Furthermore, the ability to laterally center lead tab 29 over trace 15 provided by the present invention not only reduces the likelihood of later life solder connection failure, but also ensures the lowest attenuation connection therebetween, and enables the use of narrower traces as is desirable in highly integrated electronic systems.

Figure 8:
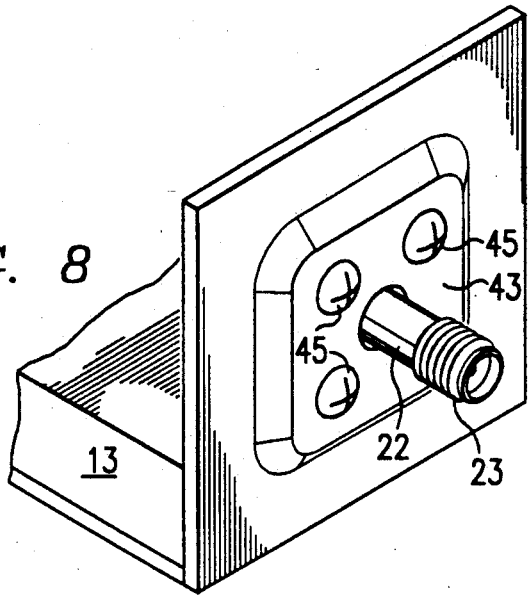
FIG. 8 is a perspective view of the connector according to the preferred embodiment of the invention as implemented into the sheet metal chassis of FIG. 7.
Figure 7:
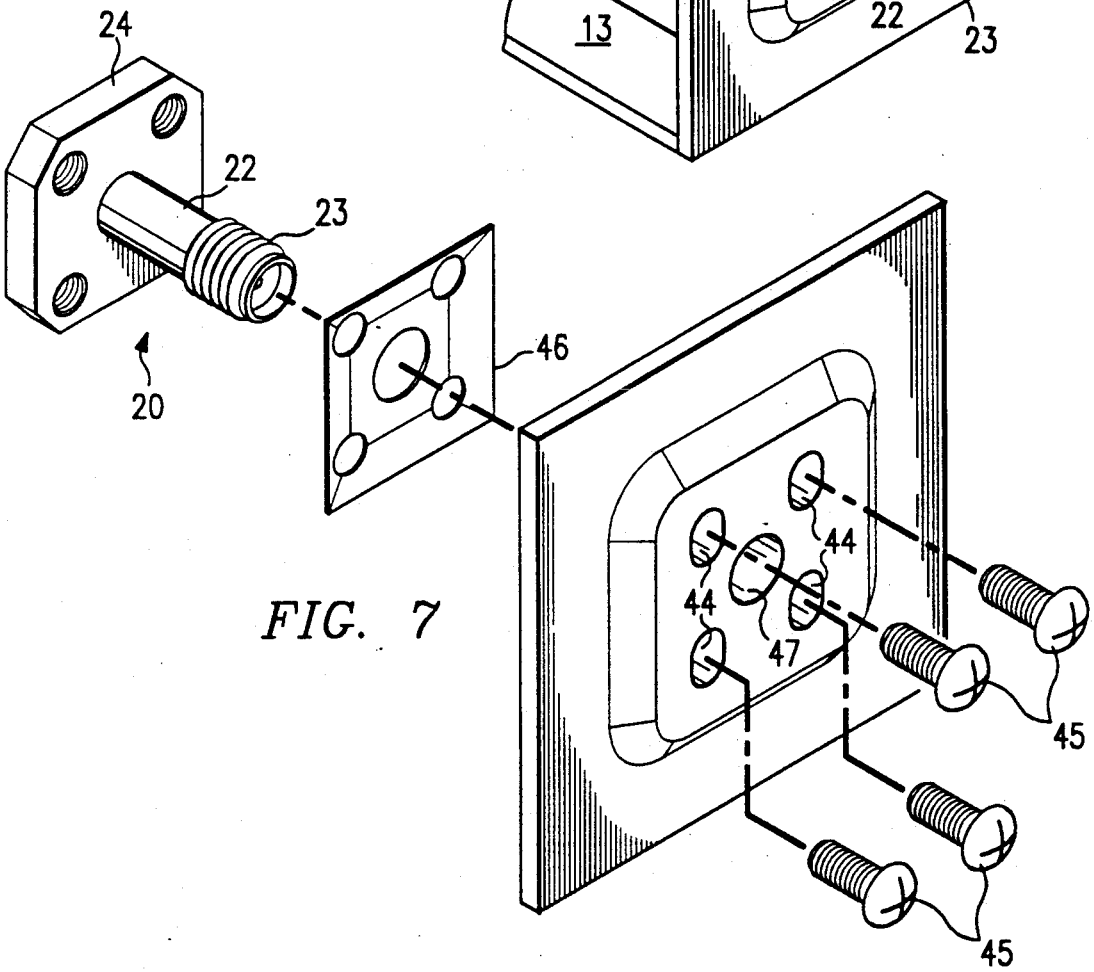
FIG. 7 is an exploded view of the connector according to the preferred embodiment of the invention as implemented into a sheet metal chassis.

The present invention further enables the use of sheet metal chassis for high frequency applications, such as in the UHF field. Heretofore, sheet metal could not be used as the chassis for UHF equipment, as the formation of a sheet metal chassis could not meet the high tolerance necessary for the use of conventional connectors. Due to the ability of the connector according to the present invention, however, high precision chassis construction is no longer required in order for high reliability and low attenuation coaxial to microstrip connection, as discussed above. Referring now to FIGS. 7 and 8, a second embodiment of the invention utilizing a sheet metal chassis will now be described in detail.

FIG. 7 is an exploded view of a portion of sheet metal chassis 40 into which connector 20, as described above, may be mounted in order to provide a coaxial to microstrip transmission line connection. Only a portion of a wall of sheet metal chassis 40 is illustrated in FIG. 7 for the sake of clarity; sheet metal chassis 40 will, of course, extend to form an enclosure having a bottom and additional sides, into which a substrate with microstrip transmission lines may be placed.

Chassis 40 includes dimple 43 within its wall at the location at which connector 20 is to be connected, and thus at a location that is selected so that lead tab 29 of connector 20 will mate with the desired microstrip transmission line trace on the substrate. The depth of dimple 43 is preferably approximately the same as the thickness of plate 24 of connector 20, for example on the order of 0.090 inches, so that the inner face of plate 24 of connector 20 will, after installation, be substantially flush with the inner surfaces of the wall of chassis 40. As in the case of the machined chassis 30 described hereinabove, according to the present invention the tolerance of the location of dimple 43 may be relatively loose, as the fine position of connector 20 relative to the transmission line may be determined after installation. It is desirable, from a manufacturing cost standpoint, that dimple 43 be formed by way of conventional low cost metal stamping techniques, as the dimensional tolerance of conventional stamping is contemplated to be sufficient for UHF connection using connector 20 according to the preferred embodiment of the invention.

Bolt holes 44 and center hole 47 are also stamped or otherwise cut through sheet metal chassis 40 within dimple 43. Bolt holes 44 are non-tapped holes that are oversized relative to machine screws 45 that are to pass therethrough and thread into tapped threaded holes 25 in plate 24. The oversizing of bolt holes 44 is preferably greater in the vertical direction to account for relatively wide tolerances in the thickness of the substrate and the vertical position of dimple 43 from the floor (not shown) of sheet metal chassis 40; some amount of oversizing of bolt holes 44 in the lateral direction is also desirable to allow for lateral centering of lead tab 29 onto the trace as described above relative to FIG. 6. Center hole 47 is similarly oversized, to allow for threaded end 23 and throat 22 to pass therethrough and to be located therewithin over the range provided by the oversizing of bolt holes 44.

EMI shielding gasket 46 is also provided in this embodiment of the invention, and is constructed similarly as gasket 36 described hereinabove, except that the top lip is unnecessary since chassis 40 does not have a slot through which throat 22 is placed. Gasket 46 includes a center hole and corner bolt holes to match throat 22 and bolt holes 24 of connector 20, as before.

Installation of connector 20 in this embodiment of the invention begins with placement of gasket 46 onto connector 20 over threaded end 23 and extending throat 22, so that the corner holes thereof match up to bolt holes 25 in plate 24. The assembly of gasket 46 and connector 20 is then placed into dimple 43 with threaded end 23 extending through center hole 47, so that lead tab 29 (not visible in FIG. 7) protrudes into the enclosure defined by sheet metal chassis 40. Machine screws 45 are placed through bolt holes 44 and threaded (but not tightened) into tapped threaded holes 25 in plate 24 of connector 20. After installation of connector 20 into dimple 43, the substrate (not shown) is placed within sheet metal chassis 40, so that the desired microstrip transmission line trace underlies lead tab 29 of connector 20.

After insertion of the substrate, the position of connector 20 can then be finely adjusted relative to the transmission line trace until lead tab 29 is laterally centered relative to its corresponding trace, and positioned above its trace by the desired gap distance (e.g., 0.002 inches). The oversizing of holes 44 allows adjustment primarily in the vertical direction, and also some degree of lateral adjustment. After adjustment of the position of connector 20, machine screws 45 are then tightened to hold connector 20 in the desired position, followed by soldering lead tab 29 to its corresponding trace.

FIG. 8 is a perspective view of this embodiment of the invention, illustrating the outer appearance of a portion of sheet metal chassis 40 after connector 20 is installed thereinto.

Other sheet material may be used in place of sheet metal in this embodiment of the invention. For example, a non-conductive material such as plastic may be used as the chassis, having its dimensions and features, such as the dimple and holes, formed by low cost methods such as injection molding.

As in the case of machined chassis 30, the present invention provides the significant advantages that a high reliability connection may be made to a microstrip transmission line, without requiring extremely tight manufacturing tolerances; indeed, the present invention enables the use of sheet material, such as sheet metal, as the chassis even for UHF applications. The connection provided according to the present invention is of sufficiently high quality that the likelihood of significant signal attenuation due to impedance discontinuities and poor ohmic connection is substantially reduced. The possibility of mechanical stress resulting from the thermal expansion of insulating material in the connector is much reduced, and the ability to properly install multiple connectors in a single chassis is much improved over conventional techniques.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A mountable connector for making electrical connection between a cable and a conductive line on a substrate, comprising:

a mounting plate having a plurality of tapped threaded holes therein;

an extended coupling throat connected to a first side of said mounting plate, and having an end for mechanically coupling to a cable;

a conductive gasket, having a center hole mating with said extended coupling throat, and having bolt holes mating with the tapped threaded holes in said mounting plate, and a wire lead extending from a second side of said mounting plate, and in electrical connection with a conductor within said extended coupling throat, said wire lead suitable for connection to a conductive line.

2. The connector of claim 1, wherein said conductive gasket has a lip on one edge thereof, said lip bending away from said mounting plate.

3. A high frequency electronic system, comprising:

a substrate having a transmission line thereon, said transmission line having a trace extending toward an edge of said substrate;

a chassis having an enclosure defined by a wall, within which said substrate is disposed, said wall having bolt holes and a connector hole therethrough;

a connector for coupling said transmission line trace to a cable, comprising:

a mounting plate disposed between a portion of said wall and said substrate, having a plurality of tapped threaded holes therein mating with said bolt holes in said wall;

a coupling throat connected on a first end to said mounting plate extending through said wall, and having a second end for mechanically coupling to a cable; and a wire lead extending from said mounting plate toward and in electrical connection with said transmission line trace, and in electrical connection with a conductor within said coupling throat; and bolts for securing said connector to said wall, said bolts passing through said bolt holes and threadably engaged in said tapped threaded holes in said mounting plate.

4. The system of claim 3, wherein said transmission line is a microstrip transmission line.

5. The system of claim 3, wherein said second end of said coupling throat is for making connection to a coaxial cable;

and wherein said wire lead is electrical connection with a center conductor within said coupling throat.

6. The system of claim 3, wherein said connector further comprises:

insulating material surrounding said wire lead, and contained substantially fully within said coupling throat and within said mounting plate, so as not to substantially extend from said mounting plate.

7. The system of claim 3, wherein said bolt holes are larger than said bolts.

8. The system of claim 25, wherein said bolt holes are larger in the vertical direction than in the lateral direction.

9. The system of claim 3, wherein said connector hole is a slot extending to the top of said wall, said slot disposed within a cavity machined into said wall, said cavity for receiving said mounting plate.

10. The system of claim 9, further comprising: a conductive gasket, having a center hole mating with said throat, having holes therethrough mating with the tapped threaded holes in said mounting plate, and having a lip on a top edge thereof mating with said slot in said wall.

11. The system of claim 3, wherein said connector hole is disposed within a dimple in said wall, said dimple for receiving said mounting plate thereinto.

12. The system of claim 11, wherein said chassis is formed of sheet material.

13. The system of claim 12, further comprising:

a conductive gasket, having a center hole mating with said coupling throat, and having holes therethrough mating with the tapped threaded holes in said mounting plate.

14. A method of installing a connector into a chassis to make connection between a cable and a conductor on a substrate, said connector having a mounting plate with tapped threaded holes therein, a coupling throat connected to a first side of the mounting plate, and a wire lead extending from a second side of said mounting plate, comprising the steps of:

inserting said coupling throat through a hole in a wall of said chassis, said wall also having non-threaded holes therethrough corresponding to said tapped threaded holes in said mounting plate;

threading bolts into the tapped threaded holes in said mounting plate, said bolts passing through the non-threaded holes in said wall so that said mounting plate is held against said wall by said bolts;

adjusting the position of said mounting plate relative to the substrate so that said wire lead is positioned over the conductor on the substrate;

tightening said bolts; and connecting said wire lead to said conductor.

15. The method of claim 14, further comprising:

mounting a conductive gasket onto said mounting plate, said conductive gasket having a hole through which said coupling throat extends.

16. The method of claim 14, wherein said conductor is a trace of a microstrip transmission line on said substrate;

wherein said connecting step comprises soldering; and further comprising:

coupling a coaxial cable to the end of said coupling throat extending through said wall.

* * * * *